US005718528A

United States Patent [19]

Halket et al.

[11] Patent Number: 5,718,528

[45] Date of Patent: Feb. 17, 1998

[54] CUTTING MECHANISM

[75] Inventors: Andrew R. B. Halket; Robert Charles Lewis Day, both of Cambridge, United Kingdom

[73] Assignee: Esselte N.V., St. Niklaas, Belgium

[21] Appl. No.: 556,885

[22] Filed: Nov. 2, 1995

[30] Foreign Application Priority Data

Nov. 14, 1994 [GB] United Kingdom ..... 9422954
Aug. 25, 1995 [GB] United Kingdom ..... 9517438

[51] Int. Cl.[6] ..... B41J 11/70

[52] U.S. Cl. ..... 400/621; 400/615.2; 400/621.1; 83/646

[58] Field of Search ..... 400/615.2, 621, 400/621.1, 593, 586; 83/614, 646, 647

[56] References Cited

U.S. PATENT DOCUMENTS

| | | | |
|---|---|---|---|
| 1,986,685 | 1/1935 | Soderberg . | |
| 3,861,262 | 1/1975 | Carpenter et al. | 83/642 |
| 4,003,281 | 1/1977 | Kumpf et al. | 83/477.2 |
| 4,122,740 | 10/1978 | Maltby | 83/646 |
| 4,328,729 | 5/1982 | Bartesaghi | 83/568 |
| 4,420,998 | 12/1983 | Tokuno et al. | 83/328 |
| 4,459,889 | 7/1984 | Holton et al. | 83/597 |
| 4,544,293 | 10/1985 | Cranston et al. | 400/320 |
| 5,066,152 | 11/1991 | Kuzuya et al. | 400/621 |
| 5,271,789 | 12/1993 | Takagi et al. | 156/387 |

FOREIGN PATENT DOCUMENTS

| | | |
|---|---|---|
| 0 607 026 A2 | 1/1994 | European Pat. Off. . |
| 218813 | 3/1924 | United Kingdom . |
| 1 3965 887 | 6/1971 | United Kingdom . |
| 2 049 530 A | 5/1979 | United Kingdom . |

OTHER PUBLICATIONS

Patent Abstracts of Japan, vol. 8, No. 220(M-330) [1657], 6 Oct. 1984.

*Primary Examiner*—John S. Hilten
*Attorney, Agent, or Firm*—Pennie & Edmonds LLP

[57] ABSTRACT

A cutting mechanism for a printing apparatus is described. The cutting mechanism is particularly suitable for tape printers. In the cutting mechanism, one of a cutting blade and an anvil is mounted for rolling motion with respect to the other so that as the rolling motion occurs a cut is made through the tape. Moreover, the cutting mechanism can be actuated by a handle which lies flush with the printer casing and which can be actuated externally of the casing.

20 Claims, 10 Drawing Sheets

CUTTING MECHANISM

FIELD OF THE INVENTION

The present invention relates to a cutting mechanism particularly but not exclusively for use in a printing apparatus for cutting printed tape.

BACKGROUND TO THE INVENTION

Electronic printing apparatus are known which use a supply of multilayer tape, housed in a cassette received by the printing apparatus. The multilayer tape comprises an image receiving layer and a backing layer secured to one another via an adhesive layer. After an image has been printed onto the image receiving layer, the backing layer can be removed allowing the image receiving layer to be secured to an object using the adhesive layer. Such printing apparatus include a cutting mechanism for cutting off a portion of the tape after an image has been printed onto the image receiving layer so that that portion of the tape can be used as a label. For this purpose, the cutting mechanism includes a blade which is intended to cut through all of the layers of the multilayer tape. In some printing apparatus, the cutting mechanism also includes a so-called tab cut blade which is intended to cut only through one of the layers of the multilayer tape, the image receiving layer or the backing layer, leaving the other layer intact. For example, in a machine made and sold by the present Applicants under the trade mark DYMO 6000, a tab cut blade is provided which cuts through the top image receiving layer whilst leaving the backing layer intact. Such a tab cut allows easy separation of the image receiving layer from the backing layer.

In the DYMO 6000, the tab cut blade is a ceramic blade which is set via insert moulding in a tab cut blade holder to a protrusion of about 100 microns. When a tab cut is to be made, force is applied to the blade holder to cause the blade to cut through the image receiving layer of the tape while the tape is supported by a flat anvil surface. Precise control of the amount of blade protruding from the blade holder ensures that a reliable tab cut is made which always cuts through the image receiving layer whilst leaving the backing layer intact.

One problem with this arrangement is the high force which is required, particularly when cutting wider tapes. These printing apparatus can operate with tapes having widths of 6 mm, 12 mm and 19 mm. When performing a tab cut on a 19 mm tape, the force required can be as much as 80 to 100N. For smaller printing apparatus, it is very difficult to apply the high loads which are required.

SUMMARY OF THE INVENTION

According to one aspect of the present invention there is provided a cutting mechanism comprising a cutting blade, a support surface against which material to be cut is supported, and an anvil arranged to cooperate with said cutting blade to cut said material wherein one of said cutting blade and anvil is mounted for rolling motion with respect to the other so that as said rolling motion occurs a cut is made through said material.

In the described embodiment, the anvil is mounted for rolling motion relative to the cutting blade although it will be appreciated that the principle of the present invention applies equally where a blade is mounted for rolling motion with respect to a fixed anvil, although it is expected that that would be more difficult to manufacture.

In use, the anvil is rolled down against the blade, progressively cutting across the tape. Thus, the tape is not now cut all at once and so the actuation force which is required is much lower.

The cutting mechanism can be used to provide a cut through the whole thickness of a multilayer tape, but is particularly useful to provide a tab cut in a multilayer tape. In this case, the cutting blade is mounted in a blade holder which provides a support surface adjacent the cutting blade. The blade has a controlled protrusion from the blade holder which preferably is about 100 microns. Thus, the same controlled depth principle as discussed above is utilised in the present invention but the tape is not now cut all at once and so the force is reduced. Whereas the existing printing apparatus require a ceramic blade to be used in the tab cut mechanism, the reduced forces required by the present invention permit a metal, particularly steel, blade to be used, significantly reducing costs.

Preferably the blade holder is resiliently mounted to accommodate tolerances in the cutting mechanism. Springs providing the resilient mounting of the blade holder can be preloaded so that only a small deflection from their rest position is required to apply the correct force.

In the described embodiment, the anvil is mounted with a side surface thereof adjacent at least one guide member having a guide track, the anvil having on said side surface protrusions located in said guide track for guiding said rolling motion. A further guide member can be provided located adjacent the side surface of the anvil opposed to the first mentioned side surface. If necessary the further guide member can also include a further guide track in which protrusions on the opposed side surface of the anvil will cooperate. These protrusions can take the form of balls or pins. The arrangement provides an accurate repeatable rolling motion of the anvil with respect to the cutting blade.

Preferably a biasing element is connected to return the rolling anvil from a finished position to a start position.

Where the cutting mechanism is used to provide a tab cut through a multilayer tape, it can be used in association with a second cutting blade which is arranged to cut through all layers of the material at a cutting location spaced from the location where the tab cut is made. In that case, the second cutting blade can be mounted in a cutter body which is operatively connected to the rolling anvil so that the second cutting blade cuts through all layers of the material while the tab cut blade cuts through only one of the layers.

The present invention also provides a printing apparatus which includes a cutting mechanism as hereinbefore defined.

Another problem with existing printing devices is the manner in which the cutting mechanism is actuated. In known printing devices, where the cutting mechanism is to be manually actuated, an actuating member in the form of a handle or button for example protrudes from casework of the printing device. To provide the necessary forces to generate a proper cut, there must be significant depth of travel for the cutter actuator member. This either means providing room for a button to be depressed within the casework of the printing apparatus, or providing a long protrusion from the printing apparatus. Neither of these is desirable in the construction of a small and portable printing device. It is therefore another object of the present invention to provide an improved cutter actuation member in a printing device.

Therefore, according to another aspect of the present invention there is provided a printing device having a casing which houses a printing mechanism for printing images onto a recording medium and a cutting mechanism for cutting said recording medium after an image has been printed, wherein the cutting mechanism is actuated by means of a cutter actuating member disposed externally of the casing and which is arranged to have an inoperative position lying flush with an external surface of the casing and to move between the inoperative position and an operative position to cut the recording medium, said movement being external of the casing.

In the described embodiment, the cutter actuation member comprises a first portion pivotably connected to a second portion, the second portion having a substantially planar region against which the first portion lies in the inoperative position. Thus, to actuate the cutting mechanism, the first portion is pivoted out of the inoperative position and away from the planar region of the second portion to a position in which it adopts an angle with respect to that planar portion.

This allows the user to have a firm grasp of the first portion and to provide a positive force to actuate the cutting mechanism. In the inoperative position however the cutter actuation member lies flush against the casing, which is safe and aesthetically pleasing.

In the described embodiment, the cutting mechanism comprises a cutting blade, a support surface against which material to be cut is supported, and an anvil arranged to cooperate with said cutting blade to cut said material wherein one of said cutting blade and anvil is mounted for rolling motion with respect to the other so that as said rolling motion occurs a cut is made into said material.

In this case, the cutting actuation member is moved from its inoperative position to its operative position along an arc externally of the casing to cause said rolling motion.

For a better understanding of the present invention and to show how the same may be carried into effect reference will now be made by way of example to the accompanying drawings.

DESCRIPTION OF THE PREFERRED EMBODIMENTS

Figure 1:
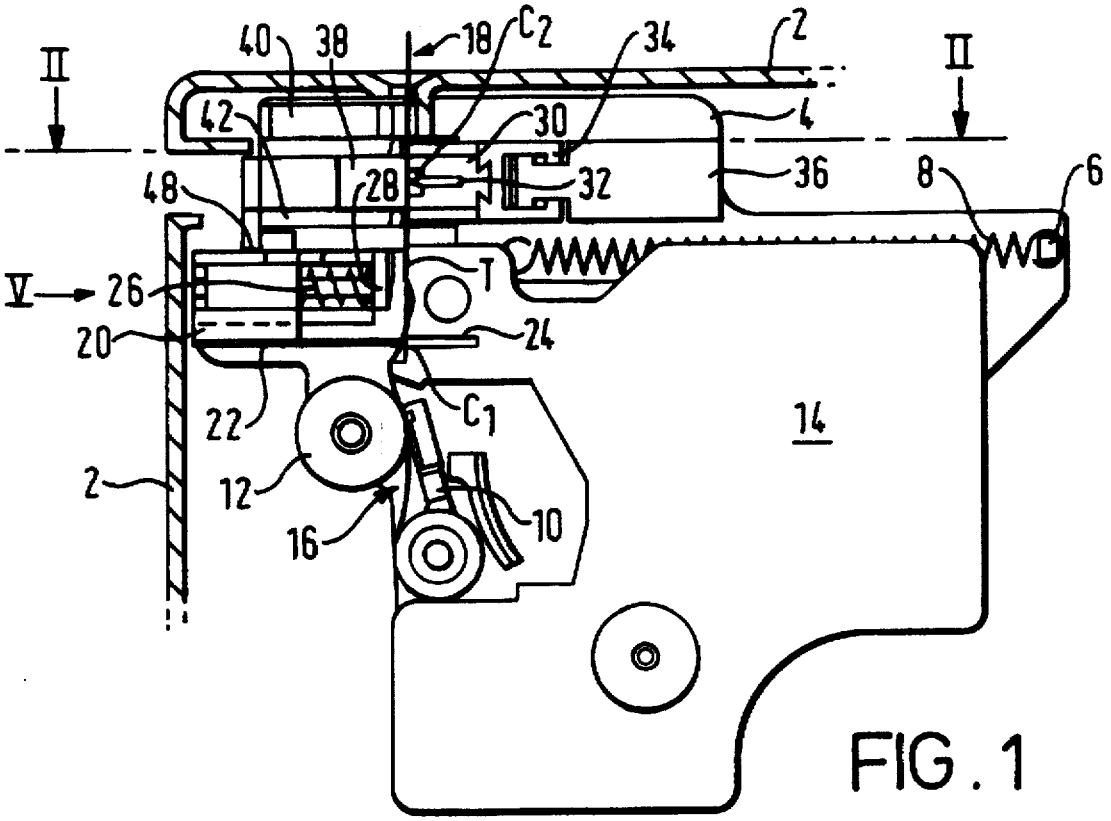
FIG. 1 is a plan view of a cutting mechanism in a printing device with a cassette present.

FIG. 1 is a plan view of a cutting mechanism in accordance with one embodiment of the present invention shown in a printing apparatus having a printing mechanism and in which a cassette is located. Reference numeral 2 designates a casing of the printing apparatus defining a cassette receiving bay. Within the casing 2 is located a base plate 4 which includes an upstanding part 6 used for mounting a return spring 8. The printing mechanism includes a printhead 10 and a platen 12 which cooperates with the printhead to effect printing on an image receiving tape T. The printhead 10 and platen 12 are mounted within the casing 2 on the base plate 4. The printhead 10 is movable from the operative position as shown in FIG. 1 to an inoperative position in which it is spaced from the platen 12 to allow easy removal and insertion of a cassette. Reference numeral 14 denotes a cassette located in the cassette receiving bay. The cassette 14 holds a supply of ink ribbon and image receiving tape which extend in overlap between the platen and printhead. The ink ribbon is then wound back within the cassette 14 and the image receiving tape extends out of the printer. Reference numeral 16 denotes the printing zone where the image receiving tape and ink ribbon extend in overlap and reference numeral 18 denotes the zone where the tape exits from the printer. Between the zones marked 16 and 18 is an area in which cutting takes place in a manner which will be more fully described.

The cutting mechanism has two main components. The first component comprises a cutter body 20 on which is mounted a blade 22. The blade is intended to cut through the full thickness of the tape T into a slot 24 provided within the cassette 14 at a first cutting location C1. The cutter body 20 moves on supports 56,58. The cutter body 20 includes at its surface adjacent the tape 18 a tape clamp 28 for holding the tape T against a supporting surface of the cassette 14 during cutting. Reference numeral 26 denotes a tape clamping spring of which there are two, one associated with each support 56, 58. Operation of this part of the cutting mechanism is disclosed in our European Patent Application No. 94304284.6 the contents of which are herein incorporated by reference.

The second part of the cutting mechanism provides a so-called tab cut through the tape at a second cutting location $C_2$ spaced from the fixed cutting location. The tape is a multilayer tape including at least an upper layer, an adhesive layer and a backing layer which can be removed from the adhesive layer so that the upper layer may be secured to an object using the adhesive layer. An image or message is printed on the upper layer of the tape. In FIG. 1, the upper layer of the tape T is to the right of the figure, adjacent the printhead. The second part of the cutting mechanism includes a blade holder 30 which holds a so-called tab cut blade 32. The tab cut blade holder 30 is mounted in a tab cut sprung body 34 which itself is sprung against a tab cut support part 36 of the printer. This part of the cutting mechanism also includes a so-called rolling anvil 38. The rolling anvil 38 is rolled down against the tab cut blade 32 causing a cut to be made progressively across the width of the tape T. The depth of cut is controlled so that the cut is made only through the upper layer of the tape, leaving the backing layer intact, to generate a so-called tab cut.

Figure 2:
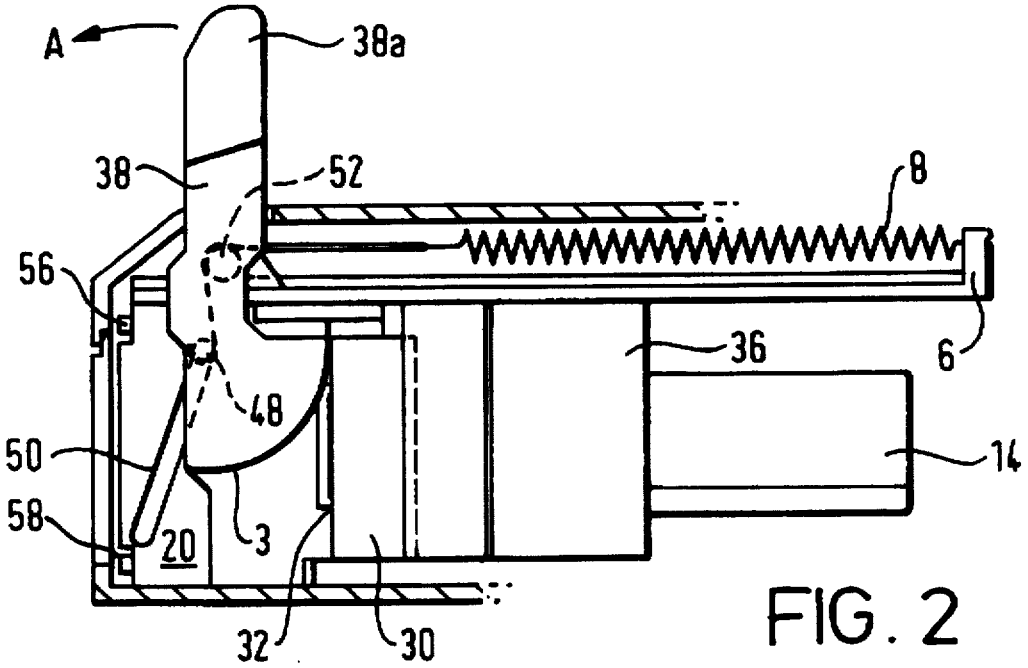
FIG. 2 is a section taken along lines II—II of FIG. 1, showing the rolling anvil in a start position.
Figure 4:
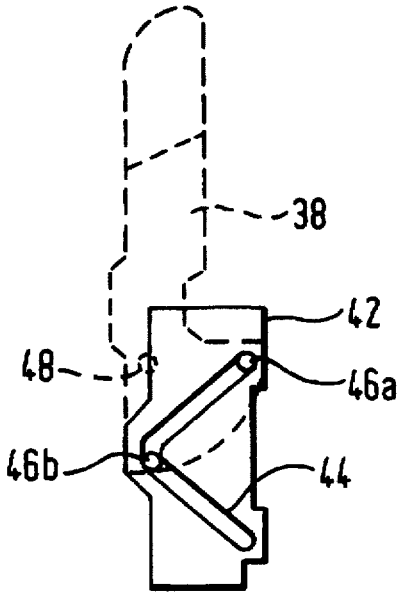
FIG. 4 is a diagram illustrating the guide mechanism for the anvil.

The rolling anvil 38 can be seen more clearly in FIG. 2 which is a view taken along line II—II in FIG. 1. It has an arcuate anvil surface 3 and an actuating part 38*a*. FIGS. 1 and 2 show the rolling anvil in the start position. The rolling anvil 38 has its motion controlled by two guides, a first guide 40 located towards the casing 2 of the printer and a second guide 42 located inwardly towards the cassette receiving bay. The guides 40,42 include guide tracks for controlling the motion of the rolling anvil 38 as shown more clearly in FIG. 4 which is a view of the guide member 42 taken from the side closest to the anvil and with the rolling anvil shown in a broken line. Reference numeral 44 denotes the guide track for the anvil. To allow it to be guided, the anvil has two protrusions, for example in the form of balls or pins 46a,46b located respectively towards the ends of its arcuate anvil surface 3. The pins 46a,46b cannot be seen in FIG. 2 because they are on the side of the rolling anvil away from the viewer. The equivalent pins located on the side of the anvil facing the viewer for cooperation in similar guide tracks in the guide 40 have been omitted from FIG. 2 for the sake of clarity. It will be appreciated that it may not be necessary in all circumstances to positively guide the anvil from both sides. Guiding by one guide only at one side may be sufficient. The rolling anvil also carries a cutter body actuation pin 48. Location of this pin is shown in FIG. 4, and is on the side of the anvil 38 away from the viewer in FIG. 2. The cutter body 20 includes a track 50 shown in FIG. 2 in which the pin 48 on the anvil 38 runs. The track 50 extends at an angle as shown in FIG. 2.

Figure 3:
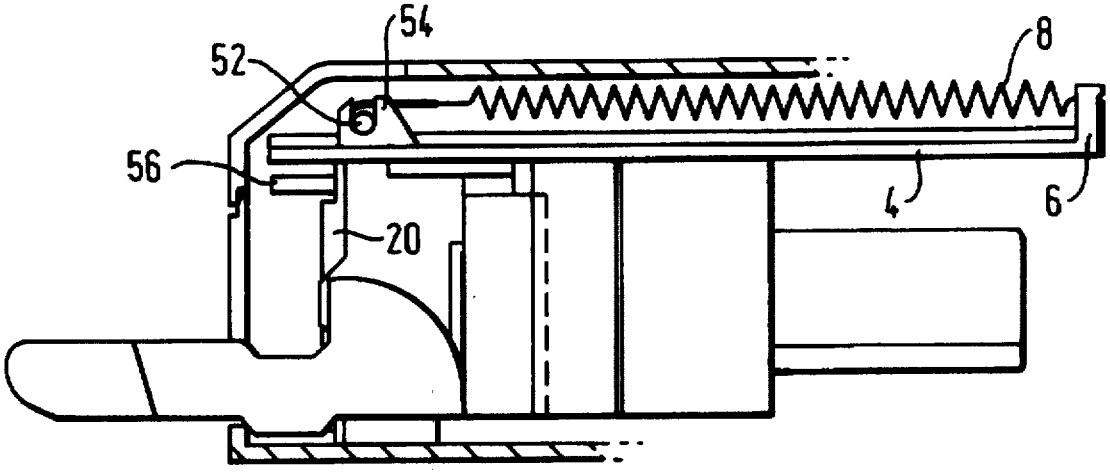
FIG. 3 is a view similar to that of FIG. 2 showing the anvil in a finish position.

Referring now to FIG. 3, the base plate 4 includes at an end of the return spring 8 opposed to the end attached to the upstanding part 6 a pulley member 52 held in a locating part 54 of the base plate. The return spring 8 is drawn over the pulley 52 onto the cutter body actuation pin 48 of the anvil 38 as shown in FIG. 2.

Figure 5:
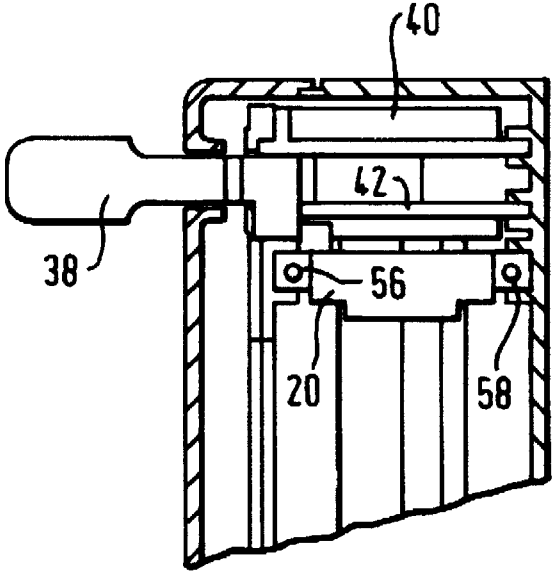
FIG. 5 is an end view taken in the direction of arrow V in FIG. 1.

FIG. 5 is a view taken in the direction of arrow V in FIG. 1. In FIG. 5 can be seen the rolling anvil 38 together with its guides 40,42. FIG. 5 also illustrates the cutter body 20. As can be seen most clearly in FIGS. 3 and 5, the cutter body 20 moves on supports 56,58.

Operation of the cutting mechanism will now be described with particular reference to FIGS. 2 to 4. FIG. 2 illustrates the start position. In this position, the return spring 8 which extends between the upstanding part 6, round the pulley member 52 to the cutter body actuation pin 48 is in a relaxed state. The guide pins 46a,46b are located in an upper portion of the guide track 44. The cutter body 20 is in a position holding the blade 22 spaced from the tape 18. To make a cut, the actuation part 38a of the rolling anvil 38 is moved in the direction of arrow A in FIG. 2. Motion of the anvil is controlled by movement of the guide pins 46a,46b in the guide track 44. As will be described more fully hereinafter, movement is controlled in a manner which ensures that the arcuate anvil surface rolls along the surface of the tab cut blade holder 30 progressively tab cutting the tape as it goes at the second cutting location $C_2$. The guide pins and guide track are located to ensure that the motion is an accurate, repeatable rolling motion.

As the rolling anvil 38 moves, the cutter body actuation pin 48 is caused to move along the track 50 in the cutter body 20. This causes the cutter body 20 to be moved to the right in FIG. 2. Movement of the cutter body actuation pin 48 downwardly also causes the return spring 8 to be extended and placed in a tensioned state. As the cutter body 20 moves to the right in FIG. 2, the blade 22 supported by the cutter body 20 performs a full cut through the tape T at the cutting location C1.

FIG. 3 shows the cutting mechanism in its finish state. The cutter body 20 is fully to the right with the blade 22 received in the slot 24 and the rolling anvil 38 has reached the end of its motion. The effect of this has been to make a full cut through the tape at the first cutting location C1 and to make a tab cut through the upper layer of the tape only by the action of the tab cut blade 32 against the arcuate anvil surface of the rolling anvil 38 at the second cutting location $C_2$. Once the actuation part 38a of the rolling anvil 38 is released, tension in the return spring 8 causes the rolling anvil 38 to return to its start position and this simultaneously causes the cutter body 20 to return to its start position.

Figure 6C:
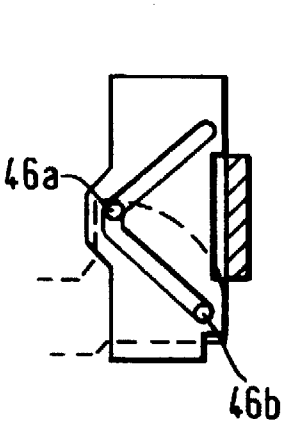
FIGS. 6*a*, 6*b* and 6*c* are diagrams illustrating the rolling motion of the anvil.
Figure 6B:
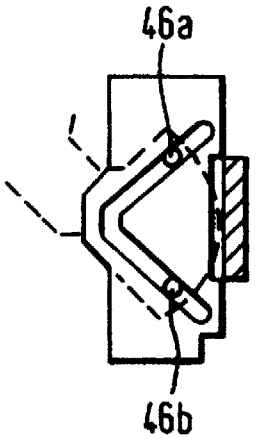
Figure 6A:
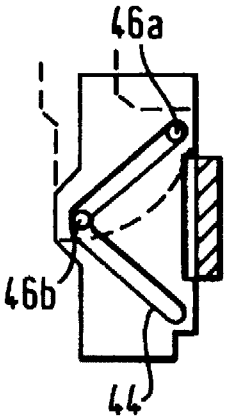

FIG. 6a to 6c illustrate the rolling action of the anvil 38. FIG. 6a shows the anvil in its start position with the guide pin 46a at one extreme end of an upper curved portion of the track 44. The guide pin 46b is at the other end of the upper curved portion of the track 44. FIG. 6b shows an intermediate position of the anvil 38 in which the guide pin 46a and the guide pin 46b are located respectively in the upper and lower portions of the track 44. FIG. 6c shows the end position with the pin 46a at one end of the lower curved portion of the track and the pin 46b at the lower end of that curved portion.

The guide track 44 on each guide member is designed to ensure an accurate repeatable rolling motion of the arcuate anvil surface against the support surface of the blade holder adjacent the cutting blade. For the described embodiment this is done by breaking down the rolling motion into a number of different parts, for example into twelve parts. Thus, the rolled position of the anvil is determined for twelve different locations and the desired location of the guide pins on the anvil is determined for those locations. Thus, the guide track can be designed.

It will readily be appreciated that in the described embodiment the rolling anvil 38 is used to perform a tab cut in association with a blade 20 which performs a full cut through all the layers of the multilayer tape. It will be readily apparent that the rolling anvil could be used by itself to perform a tab cut without association with a main cutting blade. Thus, there may be circumstances where there is no need to have a main cutting blade, or the main cutting blade could be designed independently of the rolling anvil for performing the tab cut. In that case, no cutter body actuation pin would be required. In the case where a return spring is used however it would still be necessary to provide some way of securing the return spring to the rolling anvil.

To avoid wear on the arcuate anvil surface of the rolling anvil, a groove could be made in the anvil to accommodate the blade during cutting.

It is also possible to provide a mechanism where a tab cut blade and a cut through blade are mounted on a common support to cut against a rolling anvil. The cut through blade could in that context cut against a groove on the rolling anvil.

It will be appreciated that any shape of guide track is possible provided that the necessary rolling action of the anvil is secured. In cases where there is good friction between the tape and the anvil, it may not be necessary to provide so much positive guidance within the guiding track and a simpler guiding mechanism could be used in those circumstances.

Figure 7A:
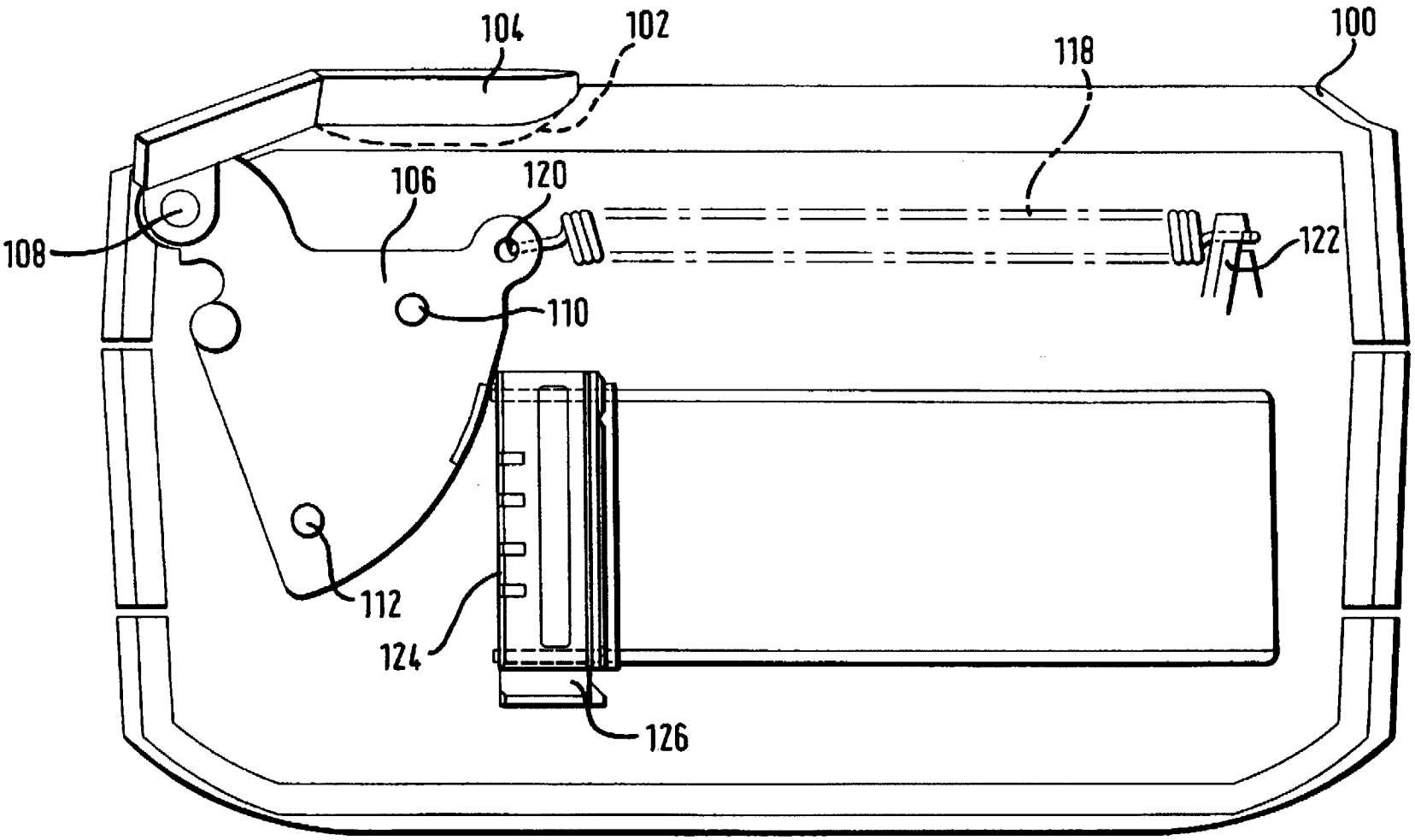
FIGS. 7*a*, 7*b* and 7*c* are diagrams illustrating operating elements of a second embodiment of the cutting mechanism in the closed position.
Figure 7B:
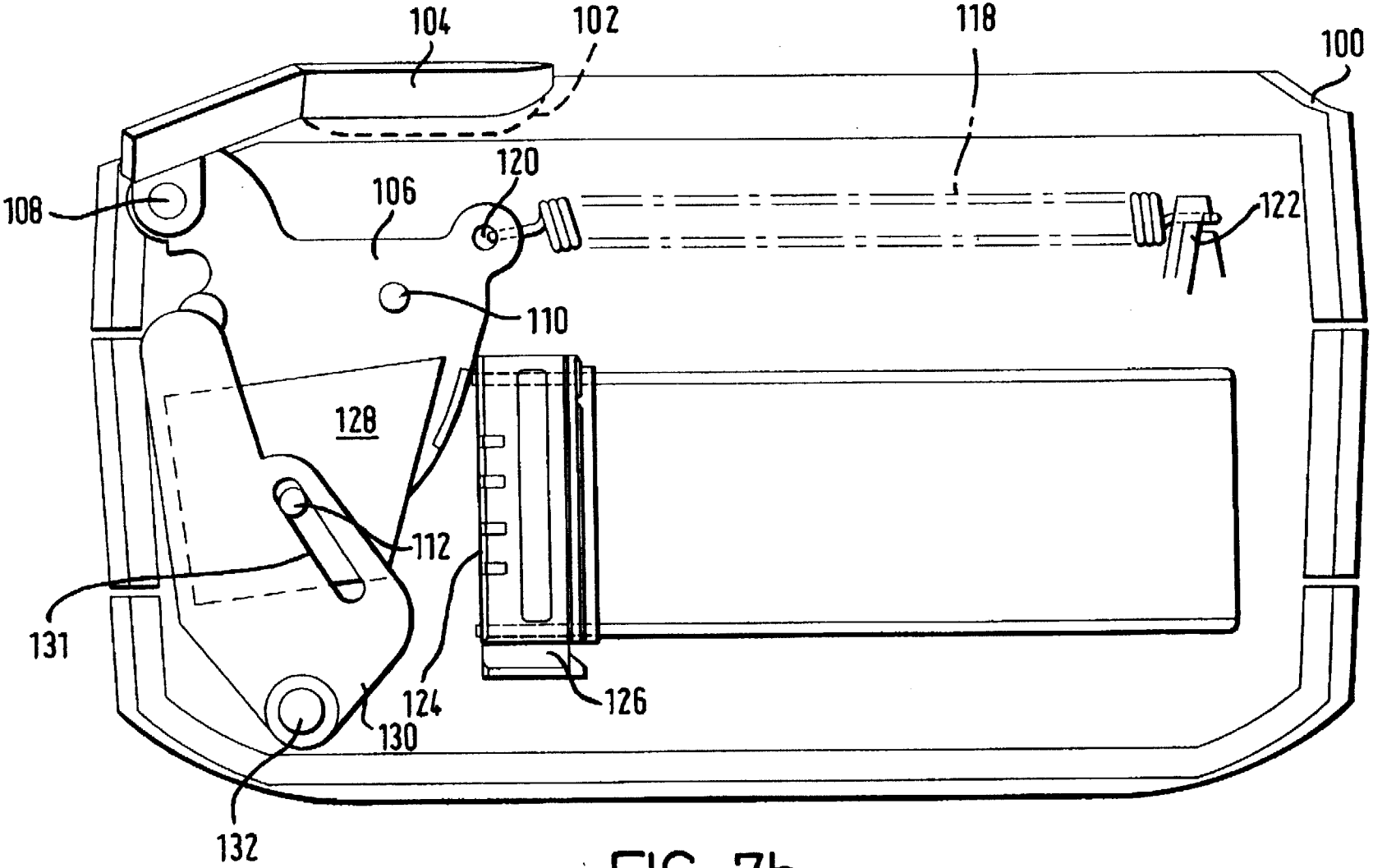
Figure 7C:
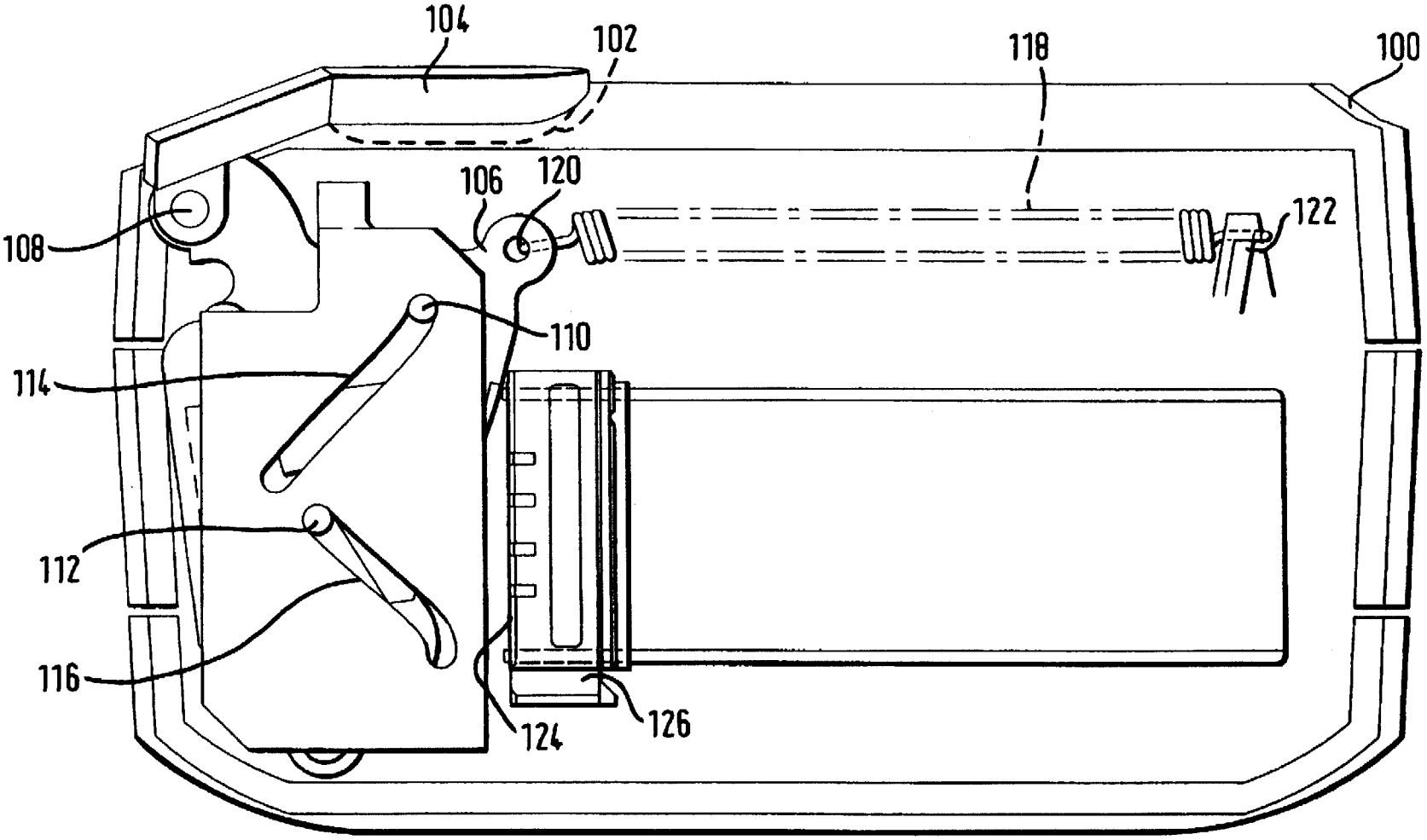
Figure 8A:
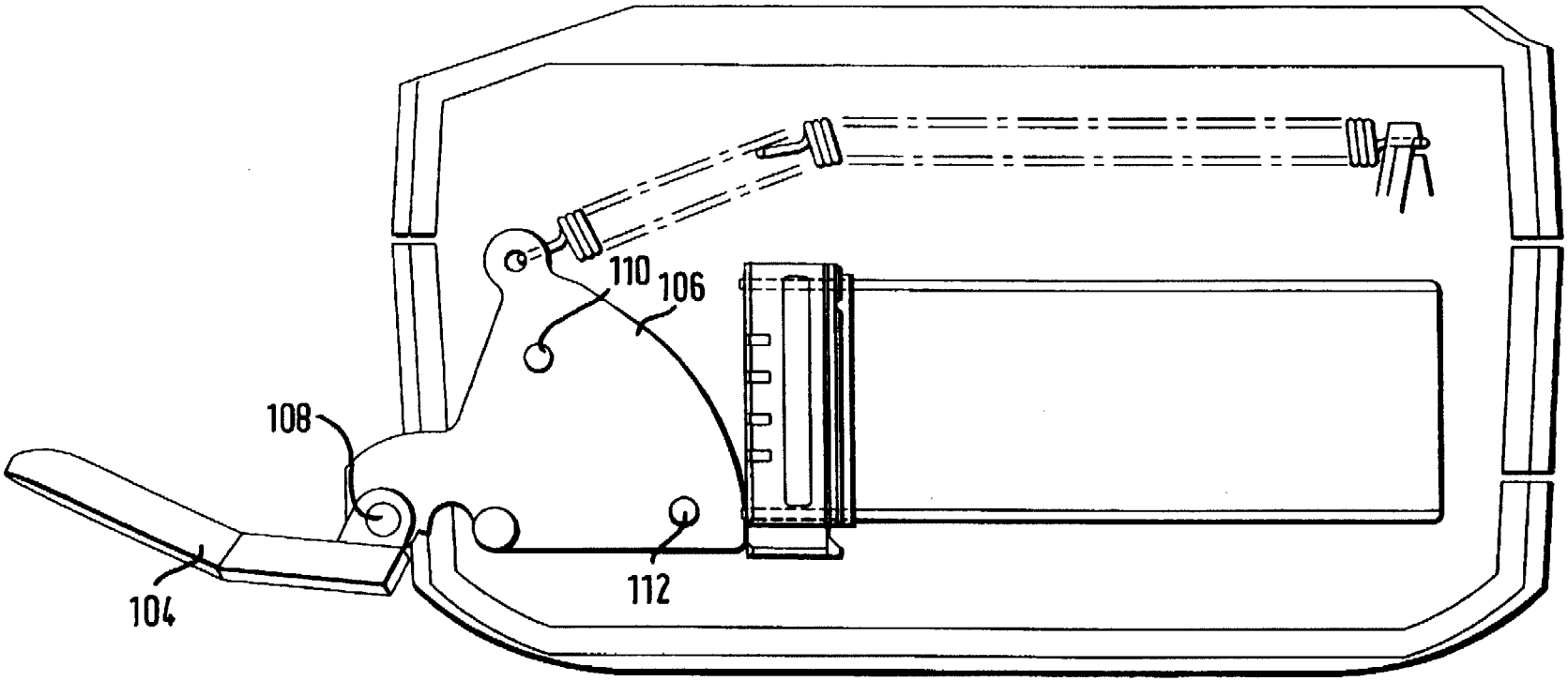
FIGS. 8*a*, 8*b* and 8*c* are diagrams as FIGS. 7*a* to 7*c*, but in the open position.
Figure 8B:
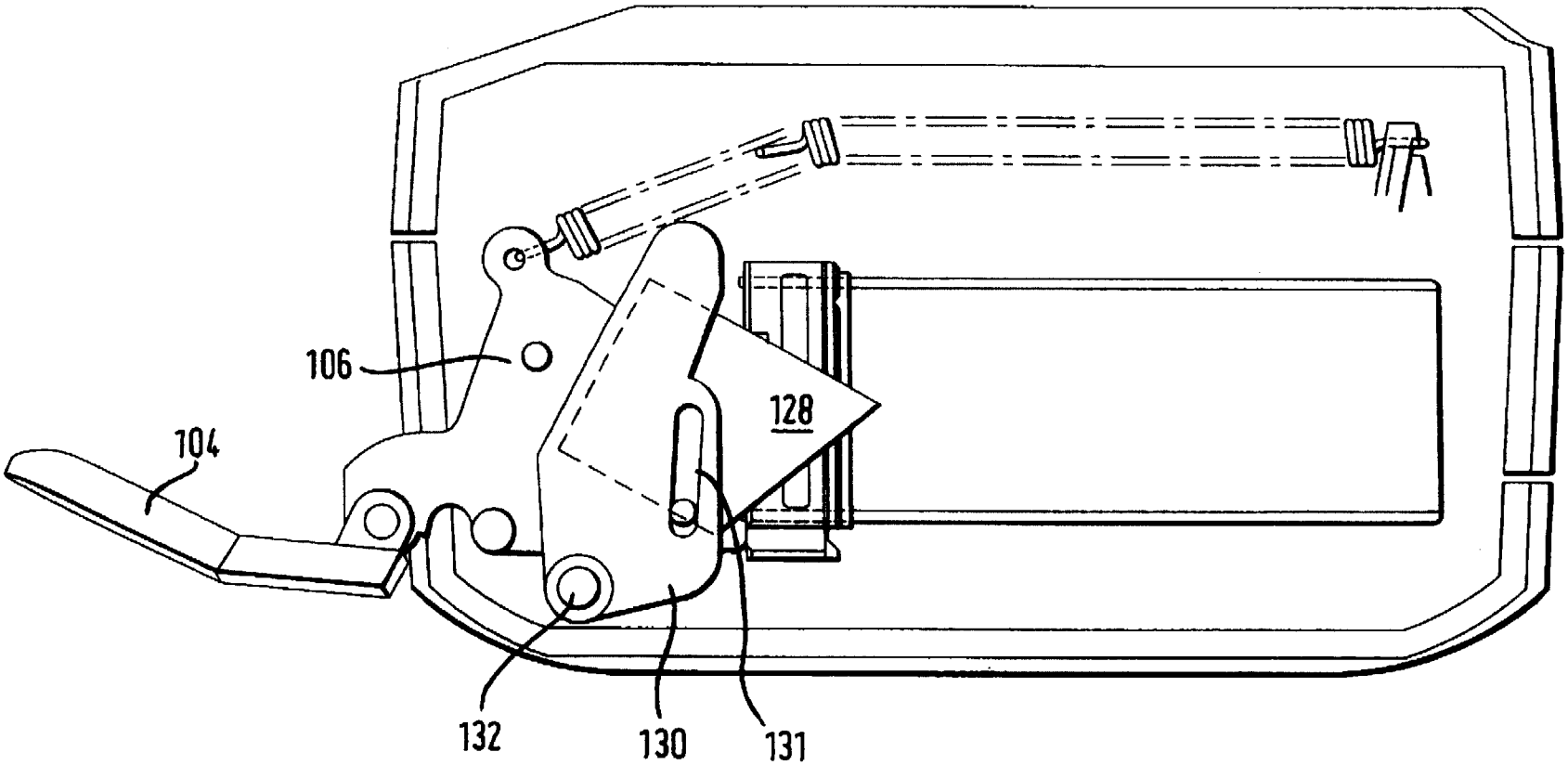
Figure 8C:
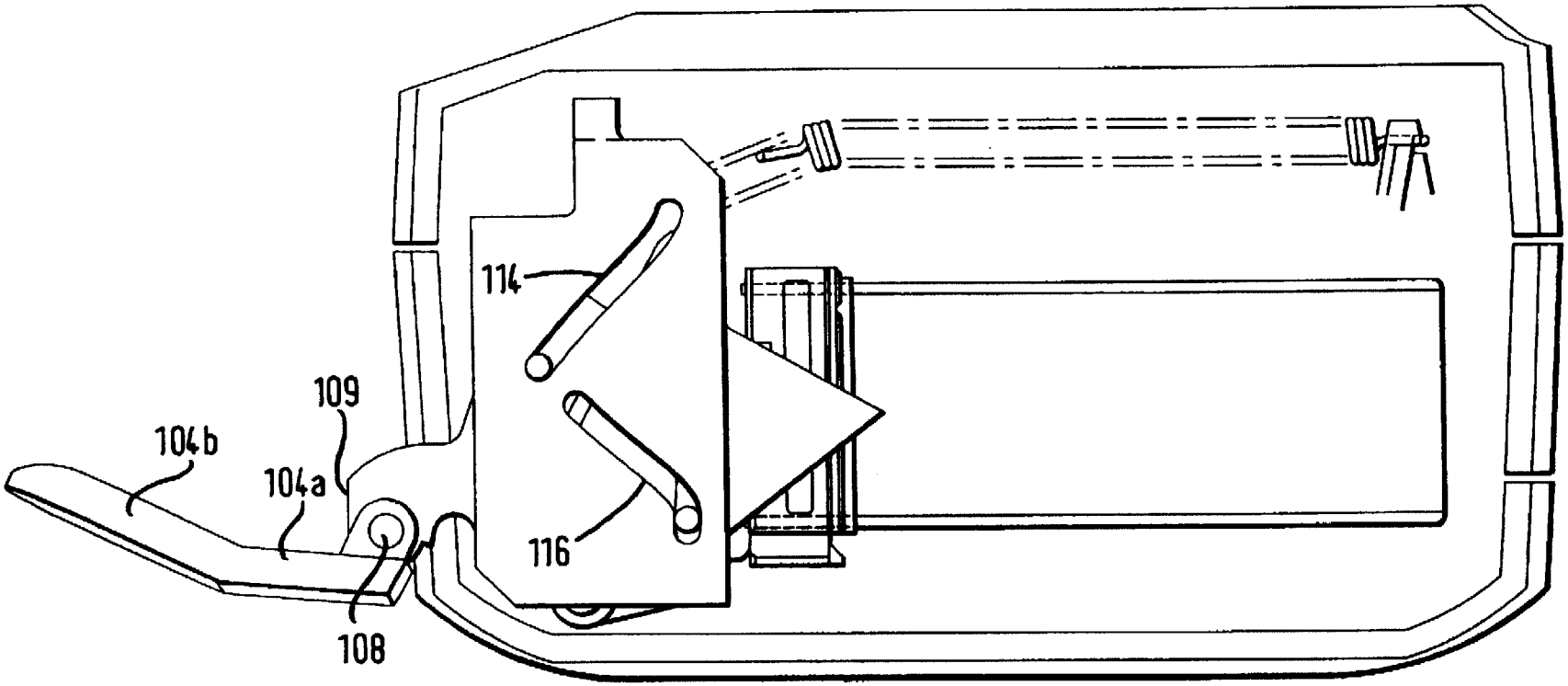

A second embodiment of the invention will now be described with reference to FIGS. 7a to 7c and 8a to 8c. The principle underlying the operation of this embodiment is the same as that which has been described above in relation to the first embodiment. However, there are some differences in the way in which the anvil and the blade are actuated. These will be discussed in more detail later. A further significant difference between the second embodiment and the first embodiment is the arrangement of the actuating part for the rolling anvil. FIGS. 7a to 7c show the cutting mechanism of the second embodiment in its retracted position. Reference numeral 100 denotes casework of the printing device. A recess 102 is formed in the top surface of the casework 100. The actuating part of the rolling anvil comprises a handle 104 which is pivotably mounted to the rolling anvil 106 at a pivot point 108. With the cutting mechanism in the retracted position, the handle 104 lies flush with the upper surface of the casing 100. The recess 102 allows a user to insert his finger to lift the handle 104. When the handle 104 is lifted up, it pivots partially about pivot point 108 to adopt an angled position shown in FIGS. 8*a* to 8*c*. Thus, the handle 104 does not pivot fully about the pivot point 108 but is prevented from pivoting further from the angled position shown in FIGS. 8*a* to 8*c*. In this position, it is used to cause the anvil 106 to adopt its rolling motion as described above. For this, the anvil has, as described above, guide pins 110,112 which move in respective guide tracks 114,116 in a guide member as described above (FIG. 7*c*). The handle 104 has first and second parts 104*a*,104*b*, the first part 104*a* providing a substantially planar portion. The pivot point 108 is provided on the rolling anvil 106 adjacent a planar portion 109 (FIG. 8*c*). The planar portion 109 and the first part 104*a* lie adjacent one another in the closed position.

As in the first embodiment, there is a return spring 118 which is connected between a pin 120 of the rolling anvil 106 and an upstanding spring support member 122. As the rolling anvil is moved from a retracted position to a cutting position, it is moved against the action of the return spring 118. 0n completion of a cut, the return spring 118 causes the rolling anvil to return to its retracted position.

In FIGS. 7*a* to 7*c*, reference numeral 124 denotes the tab cut blade. As described above, this is held in a blade holder 126.

Reference numeral 128 (FIG. 7*b*) denotes the blade for cutting fully through the thickness of the tape. This is moved from a retracted position to a cutting position by a blade actuating member 130 which is pivotably mounted at pivot point 132. The blade actuating member has a guide track 131 in which the guide pin 112 on the rolling anvil is located. As the rolling anvil 106 moves, the pin 112 causes the blade actuating member to move about the pivot point 132 and thus to cause the blade to move from its retracted position (FIG. 7*b*) to its cutting position (FIG. 8*b*). A tape clamp (not shown in FIGS. 7*a* to 8*c*, but similar to tape clamp 28 of the first embodiment) is likewise moved from its retracted position to a holding position in which the blade cuts.

Figure 9:
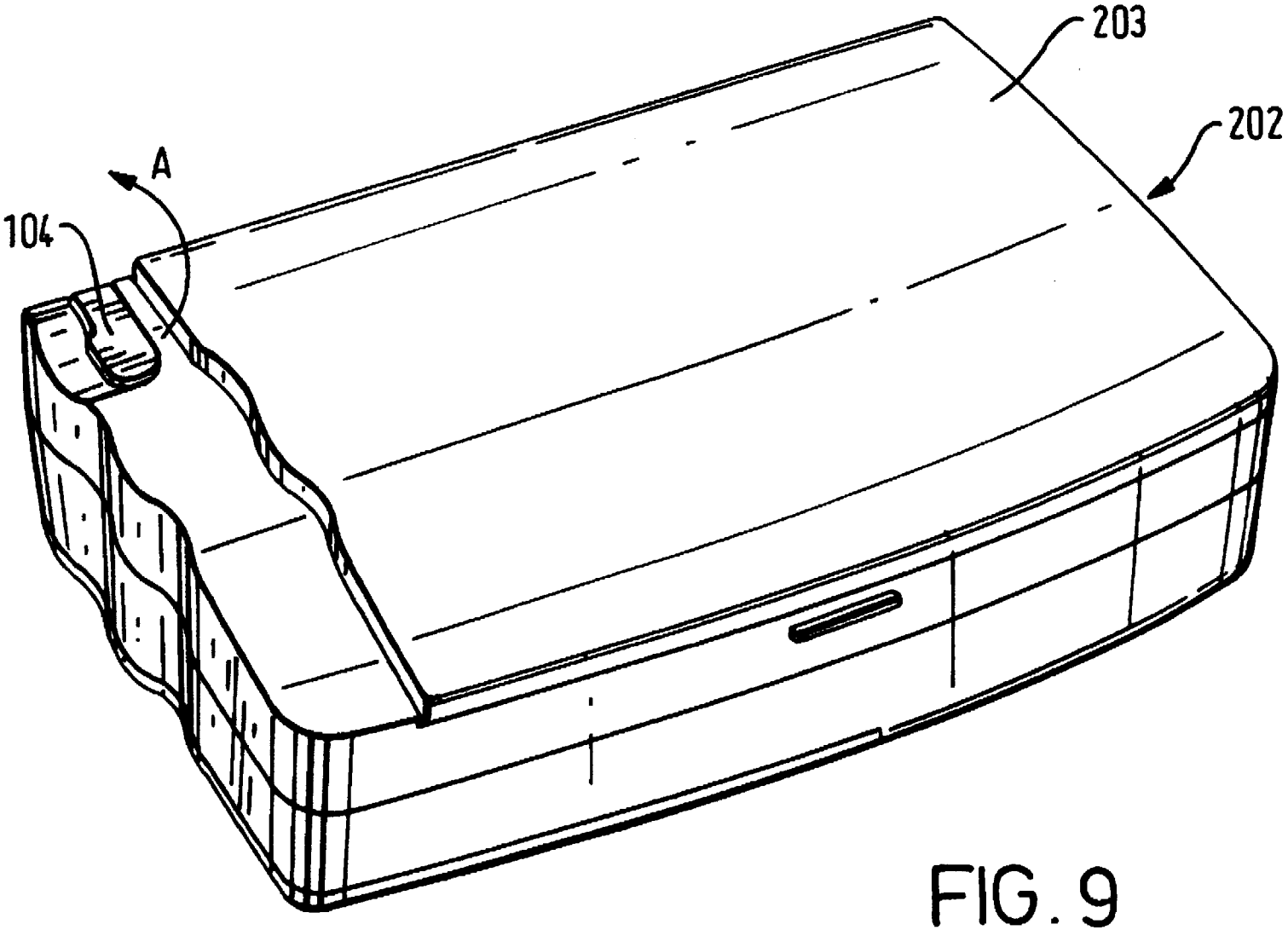
FIG. 9 is a perspective view of the external casework of a printing device.

FIG. 9 is a perspective view showing the external casing of a printing device incorporating a cutting mechanism as in FIGS. 7*a* to 8*c*. The casework is denoted generally by reference numeral 202. It comprises a lid 203 hingedly mounted to the rear of the casing 202 and beneath which is located a display and a keyboard of the printing device. A cassette receiving bay is located on the underside of the printing device. Details of the printing device of FIG. 9 apart from the cutting mechanism are described in more detail in our British Patent Application No. 9512148.9, the contents of which are herein incorporated by reference.

As can be seen on the lefthand side of FIG. 9, the handle 104 of the cutting mechanism lies substantially flush with the upper surface of the casing 202. To actuate the cutting mechanism, the handle 104 is moved in an arc externally of the casing in the direction of arrow A to operate the cutting mechanism as hereinbefore described with reference to FIGS. 7*a* to 8*c*.

It is possible to incorporate a torsion spring which acts to close the handle 104 into the recess 102 of the casework 100. Otherwise, it may be the case that friction in the handle pivot 108 can leave the handle 104 protruding from the casework 100. This could of course alternatively be dealt with by the user applying firm pressure to the handle 104.

Another possible modification is to alter the profile of the rolling anvil so that it has the effect of pushing the entire tab blade assembly back when the cutter is in its inoperative position. This would reduce the risk of tape jamming, that is reduce the chance of leading edges of labels catching on the tab cut blade as they are driven past it.

What is claimed is:

1. A tape printing apparatus comprising a supply of multilayer tape that includes an image receiving layer, a printing mechanism for printing an image onto the image receiving layer of the tape and a cutting mechanism comprising a cutting blade positioned at a cutting location, a support surface against which said material to be cut is supported at both sides of said cutting location, an anvil arranged to act against said support surface and to cooperate with said cutting blade to cut said material, and a mounting system for mounting one of said cutting blade and anvil and providing rolling motion with respect to the other so that as said rolling motion occurs a cut is made into or through said material.

2. A cutting mechanism according to claim 1 wherein the support surface is configured in the form of a blade holder in which the cutting blade is mounted.

3. A cutting mechanism according to claim 1 or 2 wherein the mounting system mounts the anvil for rolling motion relative to the cutting blade.

4. A cutting mechanism according to claim 2 wherein the mounting system mounts the anvil for rolling motion relative to the cutting blade and includes means for resiliently mounting the blade holder.

5. A cutting mechanism according to claim 1 which comprises a biasing element connected to return the rolling one of the cutting blade and anvil from a finish position onto a start position.

6. A cutting mechanism according to claim 1 wherein the material to be cut has a plurality of layers and the mounting system is arranged to urge the cutting blade to cut through at least one but not all of said layers.

7. A cutting mechanism according to claim 6 which comprises a second cutting blade arranged to cut through all layers of the material at a cutting location spaced from the first-mentioned cutting blade.

8. A cutting mechanism according to claim 7 wherein the second cutting blade is mounted in a cutter body which is operatively connected to the rolling one of the first-mentioned cutting blade and the anvil so that the second cutting blade cuts through all layers of the material while the first-mentioned cutting blade cuts through at least one but not all of said layers.

9. A cutting mechanism according to claim 7, wherein the second cutting blade is mounted on a support on which is mounted the first mentioned cutting blade.

10. A cutting mechanism which comprises a cutting blade, a support surface against which material to be cut is supported, an anvil arranged to act against said support surface and to cooperate with said cutting blade to cut said material, and a mounting system for mounting said anvil and providing rolling motion thereto with respect to the cutting blade so that as said rolling motion of the anvil occurs a cut is made into said material, said mounting system comprising at least one guide member having a guide track, wherein the anvil is mounted with a first side surface adjacent said at least one guide member, the anvil having protrusions on said first side surface, said protrusions being located in said guide track for guiding said rolling motion.

11. A cutting mechanism according to claim 10 which includes a further guide member located adjacent a second side surface of the anvil opposed to said first side surface.

12. A cutting mechanism according to claim 11 wherein the further guide member includes a further guide track and the second side surface has further protrusions located in said further guide track for guiding said rolling motion.

13. A cutting mechanism according to claim 10 wherein said protrusions are balls.

14. A cutting mechanism according to claim 10 wherein said protrusions are pins.

15. A cutting mechanism comprising first and second cutting blades, a support surface against which material to be cut is supported, an anvil arranged to act against said support surface and to cooperate with said cutting blades to cut said material, a mounting system for mounting the anvil and providing rolling motion of the anvil with respect to the first cutting blade so that as said rolling motion occurs a cut is made by the first cutting blade into said material, wherein the material to be cut has a plurality of layers and the mounting system is arranged to urge the first cutting blade to cut through at least one but not all of said layers, the second cutting blade is spaced from the first cutting blade and is mounted in a cutter body which is operatively associated with the rolling motion of the mounting system to cut through all the layers of the material, wherein the anvil includes a pin, and the cutter body includes a slot and the anvil pin is located in the slot and arranged so that rolling motion of the anvil from a start position to a finish position moves the cutter body linearly from a start position to a finish position.

16. A printing apparatus comprising:

a multilayer tape which includes an image receiving tape;

a printing mechanism for printing an image onto the image receiving layer of the multilayer tape; and a cutting mechanism for cutting off a portion of tape onto which an image has been printed and for cutting through only said image receiving layer of said cut-off portion to effect a tab cut, the cutting mechanism comprising a cutting blade positioned at a cutting location, a support surface against which said tape to be cut is supported at both sides of said cutting location, an anvil arranged to act against said support surface and to cooperate with said cutting blade to cut said tape, and a mounting system which mounts one of said cutting blade and anvil and provides a rolling motion with respect to the other so that as said rolling motion occurs a cut is made only through said image receiving layer of said tape.

17. A printing device having a casing which houses a printing mechanism for printing images onto a multilayer tape which includes an image receiving tape, and a cutting mechanism for cutting said tape after an image has been printed on the image receiving layer, said cutting mechanism including a cutting blade an anvil, and a mounting system for mounting said anvil and providing rolling motion thereto with respect to the cutting blade, said cutting mechanism being actuated by means of a cutter actuating member disposed externally of the casing and arranged to have an inoperative position lying flush with an external surface of the casing, said cutter actuating member moving between the inoperative position and an operative position to engage the mounting system to impart a rolling motion to the anvil to cut the tape, said movement of the cutter actuating member being external of the casing.

18. A printing device according to claim 17 in which the cutter actuation member comprises a first portion pivotably connected to a second portion, the second portion having a substantially planar region against which the first portion lies in the inoperative position.

19. A printing device according to claim 17 or claim 18 in which the cutting mechanism comprises a cutting blade positioned at a cutting location, a support surface against which material to be cut is supported at both sides of said cutting location, an anvil arranged to act against said support surface and to cooperate with said cutting blade to cut said material, and a mounting system, said mounting system mounting one of said cutting blade and anvil and providing rolling motion with respect to the other so that as said rolling motion occurs a cut is made into said material.

20. A tape printing apparatus comprising a supply of multilayer tape that includes an image receiving layer, a printing mechanism for printing an image onto the image receiving layer of the tape and a cutting mechanism comprising a cutting blade positioned at a cutting location, a support surface against which material to be cut is supported at both sides of said cutting location, an anvil arranged to act against said support surface and to cooperate with said cutting blade to cut said material, and a mounting system which mounts said anvil and provides rolling motion of the anvil with respect to said cutting blade so that as said rolling motion occurs a cut into or through said material.

* * * * *